US005802425A

United States Patent [19]

Kavolius et al.

[11] Patent Number: 5,802,425

[45] Date of Patent: Sep. 1, 1998

[54] METHODS FOR RECONDITIONING USED CHARGE BLADES FOR ELECTROSTATOGRAPHIC CARTRIDGES, AND THE CHARGE BLADES AND CARTRIDGES THEREBY RECONDITIONED

[75] Inventors: Vytas A. Kavolius, Charlottesville; Joseph E. White, Mt. Crawford, both of Va.

[73] Assignee: Genicom Corporation, Chantilly, Va.

[21] Appl. No.: 770,772

[22] Filed: Dec. 20, 1996

[51] Int. Cl.[6] ..... G03G 21/00

[52] U.S. Cl. ..... 399/109; 399/120

[58] Field of Search ..... 399/174, 109, 399/350, 274, 284, 120; 427/11, 140, 299, 322, 256, 348

[56] References Cited

U.S. PATENT DOCUMENTS

| | | | |
|---|---|---|---|
| 162,514 | 7/1875 | Allen | 427/140 |
| 2,622,038 | 12/1952 | Charlesworth et al. | 427/140 |
| 3,257,945 | 6/1966 | Smith, Jr. | 101/493 |
| 3,846,223 | 11/1974 | Lederman et al. | 428/409 |
| 4,505,573 | 3/1985 | Brewington et al. | 399/284 |
| 4,681,712 | 7/1987 | Sakaibara et al. | 264/440 |
| 5,057,370 | 10/1991 | Krieg et al. | 428/403 |
| 5,308,515 | 5/1994 | Michlin et al. . | |
| 5,400,128 | 3/1995 | Michlin . | |

FOREIGN PATENT DOCUMENTS

| | | |
|---|---|---|
| 59-195672 | 11/1984 | Japan . |
| 61-176951 | 8/1986 | Japan . |
| 61-259267 | 11/1986 | Japan . |
| 06130792A | 5/1994 | Japan . |
| 6-130792 | 5/1994 | Japan . |

*Primary Examiner*—Arthur T. Grimley
*Assistant Examiner*—Quana Grainger
*Attorney, Agent, or Firm*—Nixon & Vanderhye P.C.

[57] ABSTRACT

The triboelectric harmony of reconditioned electrostatographic cartridges may be reestablished by coating a flexible charge blade with a quantity of dry, particulate electrically conductive material, for example, particulate carbon black or graphite. Preferably, the electrically conductive material is carbon black having an average particle diameter of between about 15 to about 95 nm. The surface-coated charge blade will most preferably exhibit a surface resistivity of less than about $1\times10^7$ Ω/cm (i.e., between 0 to about $1\times10^7$ Ω/cm), more preferably between about $1\times10^5$ to about $7.5\times10^5$ Ω/cm.

26 Claims, 1 Drawing Sheet

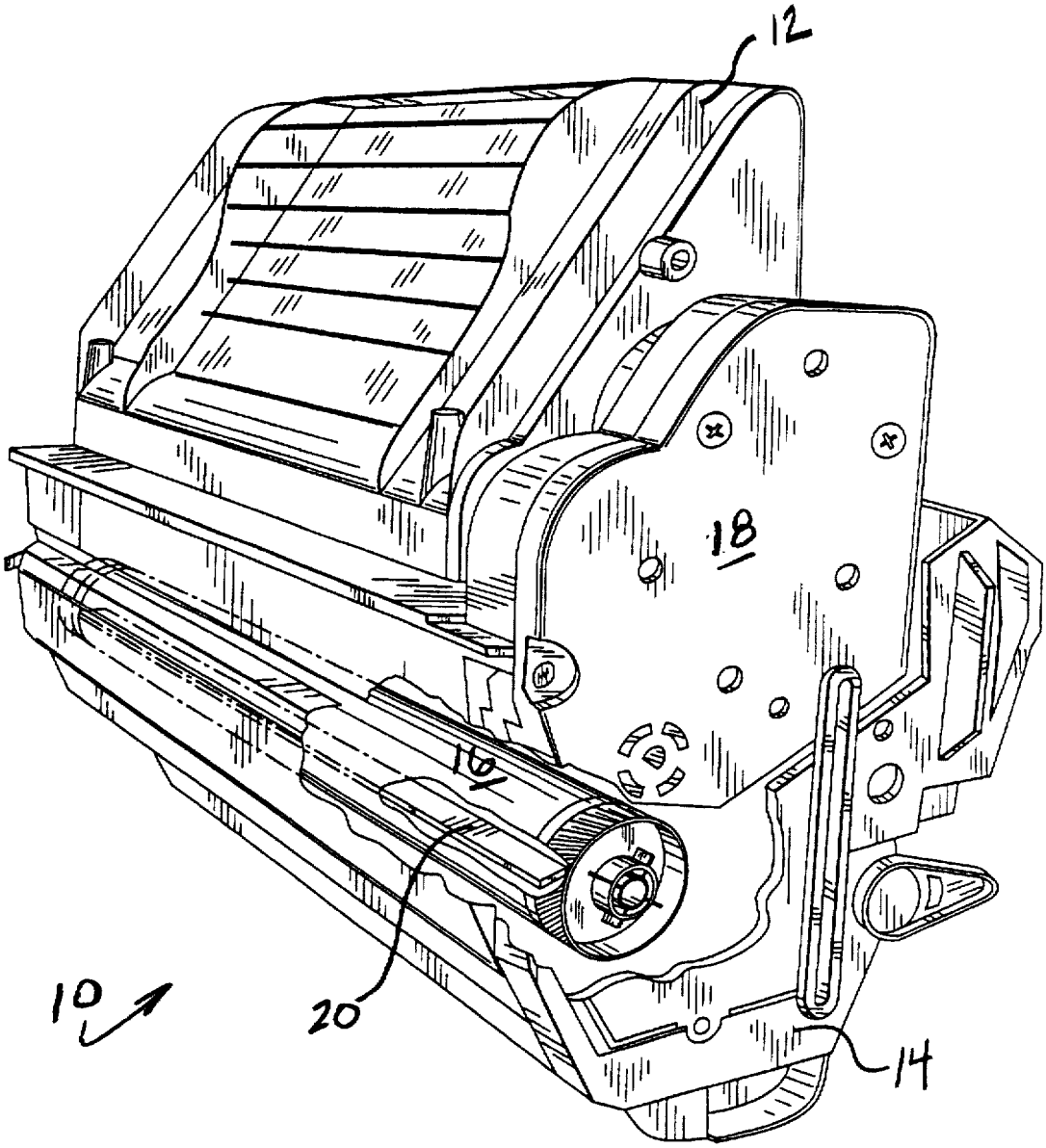
12
18
16
20
10
14

METHODS FOR RECONDITIONING USED CHARGE BLADES FOR ELECTROSTATOGRAPHIC CARTRIDGES, AND THE CHARGE BLADES AND CARTRIDGES THEREBY RECONDITIONED

CROSS-REFERENCE TO RELATED APPLICATIONS

This application may be deemed to be related to copending, commonly owned U.S. patent application Ser. No. 08/771,204 filed even date herewith entitled "Reconditioning Of Primary Charge Rollers for Electrostatographic Copying Machines", the entire content of which is expressly incorporated hereinto by reference.

FIELD OF INVENTION

The present invention generally relates to the field of electrostatographic cartridges. More specifically, the present invention relates to flexible charge blades employed in electrostatographic cartridges. In preferred embodiments, the charge blades of this invention are reconditioned so as to include a coating of carbon or graphite particles thereon so as to allow triboelectric properties of the individual cartridge components (e.g., the toner, developer roller and the photoconductor) to be harmonized.

BACKGROUND AND SUMMARY OF THE INVENTION

Flexible charge blades are conventionally used in some electrostatographic imaging cartridges so as to facilitate accurate, specific charging of toner particles employed to develop latent images on photoconductors. The flexible charge blade is normally composed of a thin piece of flexible urethane polymer fixed to a metallic (steel) support member. The flexible urethane polymer contacts the developer roller under pressure. Toner particles of a particular formula, usually a styrene-acrylate copolymer with carbon black, ferromagnetic iron oxide, polyolefins, and charge pigments/dyes, is passed between the urethane blade and the developer roller. Such physical contact causes the toner particles to be triboelectrically charged. Specific triboelectric charge and charge distribution must be generated for high quality images to be produced.

When an alternate toner is used, as in the case of remanufacturing electrostatographic toner cartridges, the triboelectric relationship between the urethane blade, toner and developer roller is changed. It is known that the toner's surface may be chemically modified with additives or that the entire toner formulation can be changed so as to recover the original triboelectric relationship between the components in the original equipment manufacturer's (OEM's) cartridge. However, either chemically modifying the individual toner particle surfaces with additives or reformulating the toner itself is costly, time-consuming and, in most cases, not predictable.

Therefore, it would be highly desirable if a technique were provided which reestablishes the triboelectric harmony between the charge blade, toner particles and developer roller during reconditioning of electrostatographic cartridges without the need to chemically modify the surfaces of the replacement toner particles. It is towards fulfilling such a need that the present invention is directed.

Broadly, the present invention is embodied in a charge blade having "engineered" triboelectric charge properties, and in methods of obtaining such charge blades. More specifically, the triboelectric harmony of reconditioned electrostatographic cartridges may be reestablished according to the present invention by coating a flexible charge blade with a quantity of dry, particulate electrically conductive material, for example, particulate carbon black or graphite on the charge blade's surface. Preferably, the electrically conductive material is carbon black having an average particle diameter of between about 15 to about 95 nm. In such a manner, therefore, electrostatographic cartridges may be reconditioned by allowing the reconditioner the option of reestablishing OEM triboelectric harmony among the various cartridge components without necessarily resorting to modifying the surface of the toner particles and/or reformulating the toner.

These and other aspects and advantages of the invention will become more clear after careful consideration is given to the following detailed description of the preferred exemplary embodiments.

BRIEF DESCRIPTION OF THE DRAWINGS

Reference will hereinafter be made to the accompanying drawing FIGURE which is a perspective view, partly in section, of an exemplary OEM supplied all-in-one electrostatographic cartridge that may include the charge blade according to the present invention.

DETAILED DESCRIPTION OF THE PREFERRED EXEMPLARY EMBODIMENTS

The accompanying FIGURE depicts an OEM "all-in-one" electrostatographic cartridge 10 that may be reconditioned according to the present invention. As is shown, the cartridge 10 generally includes a toner hopper 12 which houses a supply of toner particles for use in the electrostatographic printing process. The toner hopper 12 is attached to the cartridge base 14 which supports a rotatable developer roller (photoconductor) 16. The roller 16 is rotated synchronously with other rollers forming a part of the cartridge 10 by a gearing assembly (not shown) housed within a lateral gear housing 18.

The cartridge 10 includes a thin flexible charge blade 20 extending the entire lengthwise dimension of the developer roller 16. As is shown, the distal terminal edge of charge blade 20 is in physical contact with the exterior of the developer roller 16 so as to impart a triboelectric charge to the toner particles thereon transferred from the hopper 12. The proximal edge of the charge blade 20 is most preferably held within a rigid steel support which itself is rigidly fixed to the cartridge base 14.

The charge blade 20 is most preferably formed of a strip of urethane polymer. During reconditioning of the cartridge 10, the charge blade 20 is coated with particulate carbon black or graphite so as to reestablish the triboelectric harmony between the toner particles, developer roller and charge blade. Most preferably, the electrically conductive carbon black or graphite particles are coated onto the charge blade surface in an amount sufficient to achieve a surface resistivity of the surface-coated charge blade of less than about $1\times10^7$ Ω/cm, and more preferably a surface resistivity of between about $1\times10^5$ to about $7.5\times10^5$ Ω/cm. When coated in such a manner, high quality photocopies which exhibit homogeneous solid fill and sharp edges (e.g., no edge "fog" or "blasting") can be achieved.

Virtually any electrically conductive particles may be employed as a charge blade coating in the practice of this invention so as to reestablish triboelectric balance between the charge blade, developer roller and toner particles. For example, particulate carbon black or graphite materials can be used in the practice of this invention. Preferably, the material is carbon black having generally spherical particles with an average particle diameter of between about 15 to about 95 nm, more preferably between about 20 to about 30 nm, most preferably about 23 nm. One particularly preferred carbon black that can be used successfully in the practice of this invention is Printex L® carbon black commercially available from the Inorganic Chemical Products Division of Degussa AG. This preferred carbon black will have a jetness black value ($M_Y$ according to DIN 55 979) of about 241±6, a tinting strength (paste prepared in accordance with DIN ISO 787/16, evaluation DIN ISO 787/24 with IRB 3=100) of about 102±7, a DBP-adsorption (according to DIN 53601 or ASTM D 2414) of between about 115 to about 116±8 ml/100 g, a maximum sieve residue (according to DIN ISO 787/18, ASTM D 1514 or JIS K 5101/20) of about 0.05%, an ash content (according to DIN 53 586) of about 0.2% and a tapped density (according to DIN ISO 787/11) of between about 230 to 430 g/l.

The charge blade 20 may be coated with the electrically conductive particles in any convenient manner. Preferably, when carbon black particles are employed, the charge blade 20 is coated by physically rubbing the charge blade with a quantity of dry carbon black particles. The carbon black particles will preferentially adhere to the urethane polymer of the charge blade 20 and will, moreover, fill the microscopic pores, voids and/or pits in the charge blade surface.

Prior to coating with the carbon black particles, the polyurethane charge blade will exhibit a surface resistivity of essentially infinity. Following coating with the carbon black particles, however, the charge blade will exhibit a surface resistivity of less than about $1\times10^7$ Ω/cm (i.e., between 0 to about $1\times10^7$ Ω/cm), more preferably between about $1\times10^5$ to about $7.5\times10^5$ Ω/cm.

The amount of carbon black particles that are physically capable of being coated onto the surface of the urethane polymer charge blade 20 is self-limiting and is dependent in large part upon the surface roughness of the uncoated charge blade surface. Thus, for charge blade surfaces having a number and/or deeper microscopic surface pores, voids and/or pits, a greater quantity of carbon black particles will need to be employed in order to achieve the post-coating surface resistivity noted above, and vice-versa. Suffice it to say, however, that following coating with carbon black particles, the charge blade will exhibit harmonized triboelectric properties with the toner particles and the developer rollers.

By the term "triboelectric harmony" and like terms is meant that the charge distribution (q/d, where q is the charge in microcouloumbs, and d is mean diameter of the toner particles in microns) is as narrow as practical so as to obtain high quality photocopies having homogenous solid fill and sharp edges. The charge distribution is, in turn, dependent upon a number of variables in associated with the cartridge 10, for example, the formulation of the toner particles, the electrical properties of the developer roller and the voltage on the photoconductor. Suffice it to say here, however, that the present invention enables electrostatographic cartridges to be reconditioned by allowing the reconditioner the option of reestablishing OEM triboelectric harmony among the various cartridge components without necessarily resorting to modifying the surface of the toner particles.

Further understanding of this invention will be obtained from the following non-limiting Example.

EXAMPLE

The surfaces of polyurethane charge blades removed from Canon LBP-EX, LBP-NX, LBP-BX and LBP-WX cartridges were cleaned with a surfactant (Simple Green® surfactant commercially available from Sunshine Makers, Inc. of Huntington Beach, Calif.) so as to remove grease, oils and other foreign materials therefrom. The surface was then flushed with deionized water and allowed to air-dry. Approximately 2 gms. of Printex L® carbon black particles (Degussa AG) were applied onto a clean pad (Webril® pad commercially available from Veratech Inc. of Walpole, Mass.). The carbon particles on the pad were then rubbed onto the charge blade surface until the surface appeared glossy black, almost metallic in reflective quality. Residual free carbon black particles were removed from the charge blade surface by bringing the carbon black-coated charge blade into contact with a stream of pressurized air.

The carbon black-coated charge blades each had a surface resistivity of between about $1\times10^5$ to about $7.5\times10^5$ Ω/cm. Surface resistivity data were obtained using a test device having an electrically insulated support (Lexan® polycarbonate, General Electric Company, Schenectady, N.Y.) which carried a pair of 1.338 cm wide electrodes spaced 1 cm apart. The copper electrodes were placed in contact with the charge electrode surface and probes associated with a Simpson analog VOM (volt/ohm meter) were placed in contact with the copper electrodes. Readings from the VOM were made at its megohm range setting and noted as resistance in ohms (Ω) per centimeter (cm) of the coated surface.

The carbon black-coated charge blades were reinstalled into their respective remanufactured electrostatographic cartridge. The cartridge was then placed into a electrostatographic copier and operated against a test pattern under ambient environmental conditions and under conditions simulating computer-room environments (e.g., 19% relative humidity at 65° F. and 85% relative humidity at 90° F.). The resulting prints were compared with prints made with the same cartridges prior to charge blade reconditioning. Dramatic improvements in print qualities were observed.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of reconditioning a used charge blade of an electrostatographic cartridge comprising forming a coating on a surface of the used charge blade which consists essentially of a particulate electrically conductive material in an amount sufficient to reestablish triboelectric harmony between the charge blade, toner particles and developer roller of the cartridge.

2. The method of claim 1, wherein the electrically conductive material is particulate carbon black or graphite.

3. The method of claim 1, wherein the electrically conductive material is particulate carbon black having an average particle diameter of between about 15 to about 95 nm.

4. The method of claim 3, wherein the carbon black has an average particle diameter of between about 20 to about 30 nm.

5. The method of claim 3, wherein the carbon black has an average particle diameter of about 23 nm.

6. The method of claim 1, wherein the particulate electrically conductive material is coated onto the charge blade surface by rubbing a quantity of dry electrically conductive particles onto the charge blade surface.

7. The method of claim 6, wherein the charge blade surface has a surface resistivity of less than about $1\times10^7$ Ω/cm.

8. A method of establishing triboelectric harmony between a charge blade, developer roller and toner particles employed in an electrostatographic cartridge, comprising rubbing dry carbon black particles onto the surface of the charge blade to achieve a surface resistivity of less than about $1\times10^7$ Ω/cm.

9. The method of claim 8, wherein the charge blade has a surface resistivity of between about $1\times10^5$ to about $7.5\times10^5$ Ω/cm.

10. The method of claim 8, wherein the carbon black has an average particle diameter of between about 15 to about 95 nm.

11. The method of claim 8, wherein the carbon black has an average particle diameter of between about 20 to about 30 nm.

12. The method of claim 8, wherein the carbon black has an average particle diameter of about 23 nm.

13. A charge blade for an electrostatographic cartridge which is reconditioned according to any one of claims 1–12.

14. A charge blade for an electrostatographic cartridge comprised of a strip of urethane polymer, and a surface coating on said strip of a particulate electrically conductive material selected from the group consisting of particulate carbon black and graphite.

15. The charge blade of claim 14, wherein the surface-coated strip of urethane polymer has a surface resistivity of less than about $1\times10^7$ Ω/cm.

16. The charge blade of claim 15, wherein the surface-coated strip has a surface resistivity of between about $1\times10^5$ to about $7.5\times10^5$ Ω/cm.

17. The charge blade of claim 14, wherein said electrically conductive material is particulate carbon black having an average particle diameter of between about 15 to about 95 nm.

18. The charge blade of claim 17, wherein the carbon black has an average particle diameter of between about 20 to about 30 nm.

19. The charge blade of claim 17, wherein the carbon black has an average particle diameter of about 23 nm.

20. A reconditioned electrostatographic cartridge comprising:

a cartridge base;

a toner hopper connected to said cartridge base for holding an available stand-by quantity of toner particles therewithin;

a developer roller rotatably supported by said cartridge base for carrying an electrostatographic latent image to be transferred to a recording sheet; and a charge blade extending in lengthwise contact with said developer roller for imparting a predetermined triboelectric charge to said toner particles, wherein said charge blade includes.

21. The cartridge of claim 20, wherein the elongate strip is formed of a urethane polymer.

22. The method of claim 20 or 21, wherein the charge blade has a surface resistivity of less than about $1\times10^7$ Ω/cm.

23. The method of claim 22, wherein the charge blade has a surface resistivity of between about $1\times10^5$ to about $7.5\times10^5$ Ω/cm.

24. The charge blade of claim 22, wherein said electrically conductive material is particulate carbon black having an average particle diameter of between about 15 to about 95 nm.

25. The charge blade of claim 24, wherein the carbon black has an average particle diameter of between about 20 to about 30 nm.

26. The charge blade of claim 24, wherein the carbon black has an average particle diameter of about 23 nm.

* * * * *